US011561063B1

(12) United States Patent
Hoffman et al.

(10) Patent No.: US 11,561,063 B1
(45) Date of Patent: Jan. 24, 2023

(54) WEARABLE POUCH FOR CARRYING A HANDGUN HOLSTER

(71) Applicant: VISTA OUTDOOR OPERATIONS LLC, Anoka, MN (US)

(72) Inventors: Justin Hoffman, Elizabeth City, NC (US); Nicholas Alexander Ferros, Virginia Beach, VA (US); Evan R. McNamara, Virginia Beach, VA (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 17/397,873

(22) Filed: Aug. 9, 2021

(51) Int. Cl.

| | |
|---|---|
| ***F41C 33/00*** | (2006.01) |
| ***F41C 33/02*** | (2006.01) |
| ***F41C 33/04*** | (2006.01) |
| ***A45F 3/00*** | (2006.01) |

(52) U.S. Cl.
CPC ..... *F41C 33/0227* (2013.01); *A45F 3/005* (2013.01); *F41C 33/046* (2013.01); *A45F 2200/0591* (2013.01)

(58) Field of Classification Search
CPC .. F41C 33/048; F41C 33/0209; F41C 33/046; Y10S 224/911; A45C 1/04; A45F 2003/144; A45F 2200/0591
See application file for complete search history.

(56) References Cited

U.S. PATENT DOCUMENTS

| | | | | |
|---|---|---|---|---|
| 4,966,320 | A * | 10/1990 | DeSantis | F41C 33/0209 224/931 |
| 5,294,031 | A * | 3/1994 | Volpei | F41C 33/048 224/664 |
| 5,505,355 | A * | 4/1996 | Williams | A45F 5/02 224/664 |
| 5,829,653 | A * | 11/1998 | Kaiser | F41H 5/08 2/2.5 |
| 6,880,702 | B1 | 4/2005 | Colorado | |
| 9,476,675 | B1 | 10/2016 | Mangios | |
| 9,945,636 | B2 | 4/2018 | Thompson | |
| 10,653,231 | B2 | 5/2020 | Gordon | |

(Continued)

OTHER PUBLICATIONS

"Voodoo Hide-A-Weapon Fannypack" (Accessed Mar. 19, 2021).

(Continued)

*Primary Examiner* — Corey N Skurdal
(74) *Attorney, Agent, or Firm* — Reed Smith LLP; Matthew P. Frederick; Cheryl L. Gastineau

(57) ABSTRACT

A wearable belt pouch for concealingly carrying a handgun and holster combination. The belt pouch has a body panel hingedly joined to a front panel having a peripheral side wall. The front panel is configured to be swung upwardly from a closed position to an open position to expose the body panel and form a first access opening. Magnetic closures on each of the front panel and the body panel are configured to releasably secure the front panel to the body panel when the front panel is in the closed position. A holster engagement strip is formed in a V-shape and secured to the outer face of the body panel, wherein the holster engagement strip has a width sized for engagement with the belt clip of the holster. A second access opening in the peripheral side wall is configured to provide access to the handgun in the pouch interior.

23 Claims, 12 Drawing Sheets

(56) References Cited

U.S. PATENT DOCUMENTS

| | | | |
|---|---|---|---|
| 2014/0027479 | A1 | 1/2014 | Houge |
| 2020/0275765 | A1 | 9/2020 | Gordon |

OTHER PUBLICATIONS

"Purse or Backpack Velcro Holster" (AAccessed Mar. 19, 2021).
"Concealed Carry Fanny Pack Gun Holster for Running—Elite Survival Systems" (Accessed Mar. 19, 2021).
"DTOM Law Enforcement Concealed Carry Fanny Pack Cordura Nylon—Black" (Accessed Mar. 19, 2021).
"Ultimate Fanny Pack Holster" (Accessed Mar. 19, 2021).

* cited by examiner

WEARABLE POUCH FOR CARRYING A HANDGUN HOLSTER

FIELD

Exemplary embodiments disclosed herein relate to wearable pouches for carrying a handgun holster.

BACKGROUND

Many users of handguns carry a handgun in a holster designed to protect the handgun and hold it securely. When the handgun is to be used, the user may withdraw the handgun from the holster, and then return it to the holster when finished. Holsters can be worn in a number of ways such as on a belt at the waist, on the thigh, under an arm, or around an ankle. In some cases, the holster may allow the user to conceal the handgun, or to conceal the fact that the user is carrying the handgun.

In some situations, the user may desire to carry the handgun while wearing clothing that doesn't lend itself to the use of a belt, such as athletic clothing, a skirt or dress, or like apparel. In these situations, the user may desire to carry the handgun at or near the waistband of the clothing for easy access to the handgun to conceal the handgun.

SUMMARY

In embodiments, a belt pouch comprises a body panel defining an upper edge, a lower edge, an inner face, an outer face and first and second side edges; a front panel defining an upper edge, a lower edge, an inner face, an outer face and first and second side edges.

In embodiments, a peripheral side wall extends rearwardly from the upper edge, the lower edge and the first and second side edges of the front panel toward corresponding edges of the body panel, the peripheral side wall defining an upper side wall portion extending from the upper edge of the front panel, a lower side wall portion extending from the lower edge of the front panel, a first side wall portion and a second side wall portion extending from the first and second side edges of the front panel, wherein the upper side wall portion is hingedly joined to the upper edge of the body panel and configured to be swung upwardly from a closed position of the front panel to an open position of the front panel to expose the body panel and form a first access opening, wherein a pouch interior is formed between the front panel, the body panel and the peripheral side wall when the front panel is in the closed position, wherein the pouch interior is sized to completely enclose a handgun and a holster combination inside the pouch interior when the front panel is in a closed position, wherein the holster comprises a holster body configured for receiving the handgun and a belt clip;

In embodiments, a peripheral lip extends transversely from the lower side wall portion and the first and second side wall portions, the peripheral lip defining a lower peripheral lip portion extending from the lower side wall portion, and first and second peripheral lip portions extending from the first and second side wall portions;

In embodiments, at least one first magnetic closure element is disposed on each of the lower peripheral lip portion, and the first and second peripheral lip portions, and at least one second magnetic closure element corresponding to the at least one first magnetic closure element and is disposed at the lower edge portion, and the first and second side edges of the body panel, wherein the at least one first and second magnetic closures are configured to releasably secure the front panel to the body panel when the front panel is in the closed position.

In embodiments, a holster engagement strip defines a first end, a second end, a central portion, an inner face and an outer face, wherein the holster engagement strip has a width sized for engagement with the belt clip of the holster; wherein the holster engagement strip is secured to the outer face of the body panel, and wherein the first end and the second end of the holster engagement strip are secured to the upper edge of the body panel, and the central portion is secured to the lower edge of the body panel, wherein a first holster mounting portion is defined between the first edge of the material strip and the central portion, and a second holster mounting portion is defined from between the second edge of the material strip and the central portion, wherein the first and second holster mounting portions are free from securement to the body panel between the central portion and first and second edges of the holster engagement strip, wherein the first and second holster mounting portions are configured to mount a holster between the belt portion and the holster mounting portion. Wherein the first and second holster mounting portions are oppositely angled forming a V-shape to be configured for accommodating left and right handed holsters.

In embodiments, a second access opening extends along the upper side wall portion; the second access opening comprising a first zipper comprising mating rows of interlockable zipper teeth, and at least one zipper slider element movable along the mating zipper teeth, wherein the zipper slider element is configured to be move between an open and closed position, wherein the open position of the zipper element is configured to provide access to the pouch interior.

In embodiments, a belt defines a first belt portion comprising a first end of the belt, a second belt portion comprising a second end of the belt and a central portion disposed between the first belt portion and the second belt portion, wherein the central portion is joined to the body panel; and at least one coupler disposed on at least one of the first end of the first belt portion and the second end of the second belt portion, wherein the at least one coupler is arranged to couple together the first end and the second end.

In embodiments, the first and second holster mounting portions are each angled about 150 with respect to vertical.

In embodiments, the holster engagement strip comprises a nylon webbing material having a rigidity sufficient to support the holster and handgun combination.

In embodiments, the holster engagement strip comprises a scuba webbing material and the width of the holster engagement strip is 1.5 inches.

In embodiments, the second access opening further extends along the first side wall portion and the second side wall portion.

In embodiments, each of the body panel and the front panel further comprises padding.

In embodiments, each the layer of padding comprises synthetic closed-cell foam.

In embodiments, the layer of padding of the body panel having a rigidity sufficient to support the holster and handgun combination between the body panel and the holster engagements strap.

In embodiments, the at least one second magnetic closure element are embedded in the body panel.

In embodiments, the at least one first magnetic closure element on each of the lower peripheral lip portion comprises two spaced first magnetic closure elements, and wherein the at least one first magnetic closure element on the first and second peripheral lip portions comprises two spaced first magnetic closure elements on each of the first and second peripheral lip portions.

In embodiments, the at least one second magnetic closure element on the lower edge portion of the body portion comprises two spaced second magnetic closure elements, and wherein the at least one second magnetic closure element on the first and second side edges of the body panel comprises two spaced second magnetic closure elements.

In embodiments, the at least one first magnetic closure and the at least one second magnetic closure are rare-earth magnets.

In embodiments, the front panel further comprises at least one exterior pocket opening on the outer face of the front panel, and at least one interior pocket opening on the inner face of the front panel.

In embodiments, the first belt portion and the second belt portion each further comprises a side wing portion disposed adjacent the body, wherein each side wing portion has a triangular shape, and wherein each side wing portion comprises a shell enclosing a layer of padding.

In embodiments, the belt is a one-piece, continuous member extending from the first end of the belt, through the first side wing portion, the body panel, the second side wing portion to the second end of the belt In embodiments, the at least one coupler comprises a first coupler disposed on the first end of the first belt portion and a second coupler disposed on the second end of the second belt portion, wherein the first coupler and second coupler are to couple together the first end of the first belt portion and the second end of the second belt portion; wherein an adjustment mechanism is configured to adjust a length of one of the first and second belt portions; and wherein the adjustment mechanism comprises a cinch adjuster used to secure one of the first and second belt portions.

In embodiments, a belt pouch comprises a body panel; a front panel; wherein the front panel is hingedly joined to the body panel and configured to be swung upwardly from a closed position of the front panel to an open position of the front panel to expose the body panel and form a first access opening, wherein a pouch interior is formed between the front panel and the body panel, wherein the pouch interior is sized to completely enclose a handgun and a holster combination inside the pouch interior when the front panel is in a closed position. In certain embodiments the belt pouch further comprises at least one first closure element on at least one of the front panel, the body panel, and combinations thereof, the closure element configured to releasably secure the front panel to the body panel when the front panel is in the closed position, a holster engagement strip comprising a width sized for engagement with the belt clip of the holster; wherein the holster engagement strip is secured to the outer face of the body panel and configured to mount a holster between the body panel and the holster engagement strip; wherein the holster engagement strip is configured such that when either right-handed holster or a left-handed holster is mounted on the holster engagement strip, the holster maintains a cant at least twenty degrees above horizontal. In certain embodiments, the front panel comprises a second access opening wherein the second access opening is configured to provide access to the pouch interior without swinging the front panel to the open position; and the belt pouch further comprises a belt portion configured to secure the belt pouch around a user's waist.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
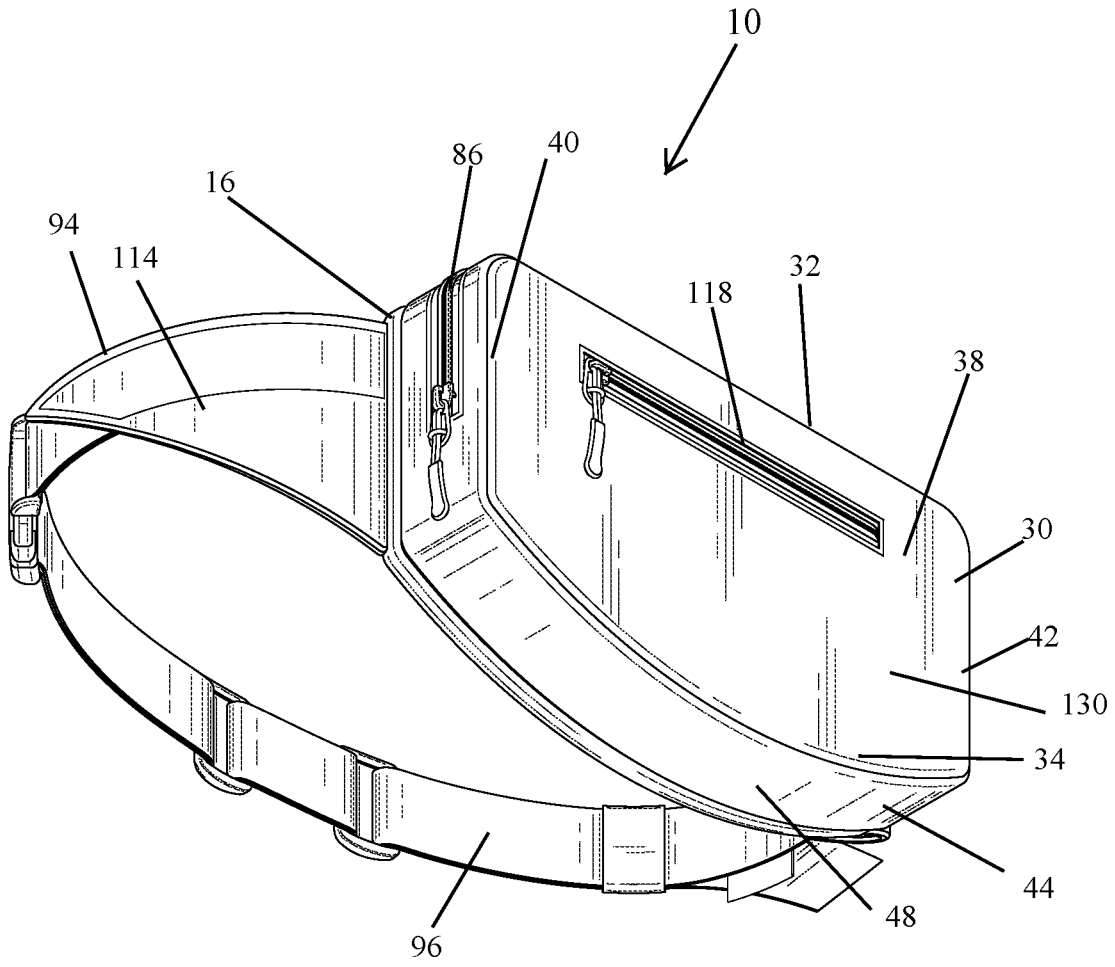
FIG. 1 is a bottom, front perspective view of the belt pouch in a closed position according to an exemplary embodiment.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

FIGS. 1-12 provide examples of embodiments of wearable pouches for carrying a holster. Elements that serve a similar, or at least substantially similar, purpose are labelled with like numbers in each of FIGS. 1-12, and these elements may not be discussed in detail herein with reference to each of FIGS. 1-12, but reference numbers associated therewith may be utilized herein for consistency. Elements, components, and/or features that are discussed herein with reference to one or more of FIGS. 1-12 may be included in and/or utilized with any of FIGS. 1-12 without departing from the scope of the present disclosure.

With reference to FIGS. 1-12, certain embodiments may include a wearable pouch 10 for carrying a handgun holster 12 supporting a handgun 14. For example, wearable pouch 10 may be a "fanny pack" style pouch configured and sized to concealingly carry a handgun holster 12 and handgun combination as well as other items and accessories while providing ready access to the handgun 14.

In embodiments, belt pouch 10 includes a body panel 16 defining an upper edge 18, a lower edge 20, an inner face 22, an outer face 24, a first side edge 26 and a second side edge 28. Body panel 16 is configured to be worn against the body of a user and is also configured to support a handgun holster 12.

Additionally, in embodiments, a front panel 30 is hingedly connected to body panel 16 and defines an upper edge 32, a lower edge 34, an inner face 36, an outer face 38, a first side edge 40 and a second side edge 42.

Figure 2:
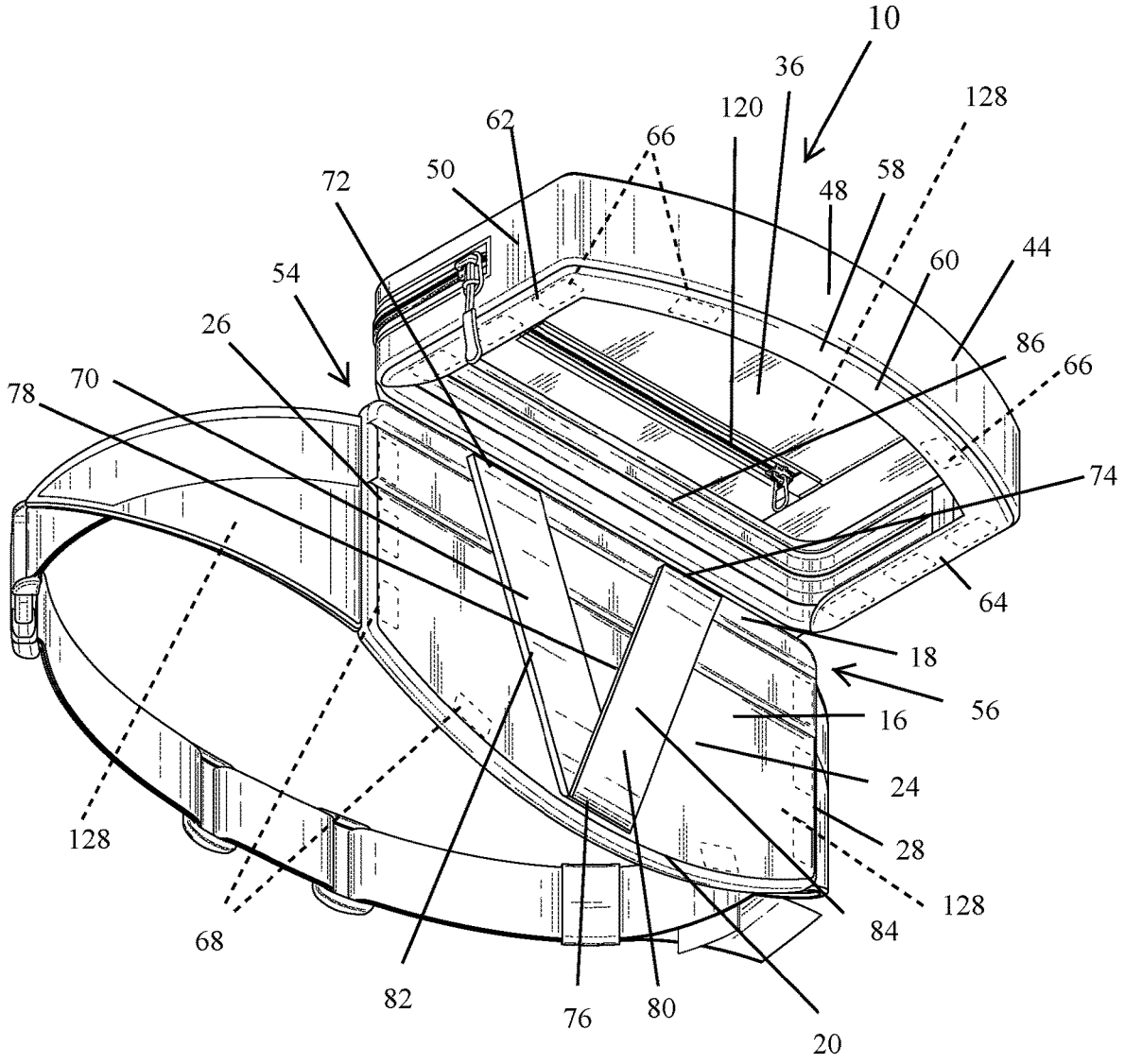
FIG. 2 is a bottom, front perspective view of the belt pouch of FIG. 1 in an open position.

In certain embodiments, referring to FIG. 2, a peripheral side wall 44 extends rearwardly from the upper edge 32, the lower edge 34 and the first and second side edges 40, 42 of the front panel 30 toward corresponding edges of the body panel 16, the peripheral side wall 44 defining an upper side wall portion 46 extending from the upper edge 32 of the front panel 30, a lower side wall portion 48 extending from the lower edge 34 of the front panel 30, a first side wall portion 50 and a second side wall portion 52 extending from the first and second side edges 40, 42 of the front panel 30, wherein the upper side wall portion 46 is hingedly joined at folding hinge 122 to the upper edge 18 of the body panel 16 and configured to be swung upwardly from a closed position to an open position to expose the body panel 16 and form a first access opening 54, wherein a pouch interior 56 is formed between the front panel 30, the body panel 16 and the peripheral side wall 44 when the front panel 30 is in the closed position. First access opening 54 is configured to provide access to the pouch interior 56 and a handgun 14 supported within the pouch interior 56

In certain embodiments, a peripheral lip 58 extends transversely from the lower side wall portion 48 and the first and second side wall portions 50, 52 of the peripheral side wall 44. Peripheral lip 58 defines a lower peripheral lip portion 60 extending from the lower side wall portion 48, and first and second peripheral lip side portions 62, 64 extending from the first and second side wall portions 50, 52 of the peripheral side wall 44.

Certain embodiments include at least one closure element on at least one of the front panel, the body panel, and combinations thereof. The closure element secures the front panel to the body panel when the front panel is in the closed position. In some embodiments, the closure element releasably secures the front panel to the body panel when the front panel is in the closed position, such that the front panel remains secured to the body panel during normal movement of the user, e.g. walking and running, but the user is able to easily release the front panel from the body panel when needed. In some embodiments, the closure element is configured such that the front panel can be released from the body panel with one hand. In certain embodiments the closure element is a magnetic element. In further embodiments, at least one first magnetic closure element 66 is disposed at each of the lower peripheral lip portion 60, and the first and second peripheral lip portions 62, 64.

Additionally, at least one second magnetic closure element 68 may be disposed at each of the lower edge 20, and first and second side edges 26, 28 of the body panel 16 at locations corresponding to the at least one first magnetic closure element 66. The at least one first and second magnetic closures 66, 68 are configured to releasably secure the front panel 30 to the body panel 16 when the front panel 30 is in the closed position. In certain embodiments, the at least one first and second magnetic closures 66, 68 are oppositely poled magnets. In other embodiments, the at least one first and second magnetic closures 66, 68 are rare-earth magnets which are strong permanent magnets made from alloys of rare-earth elements. In certain embodiments the rare-earth magnets are, for example, NdFeB magnets (also known as neodymium magnets). In still a further embodiment, the rare earth magnet comprises 24-27% Nd, 6-7% Pr, 0.1-0.3% Cu, 66%-70% Fe, and 0.9-1% B. Alternate suitable types of closures may also be used such as other magnet types, hook and loop closures, snaps, adhesive, etc. The first and second magnetic closures 66, 68 may include any element or composition that is capable of producing a magnetic field. In some embodiments, first and second magnetic closures 66, 68 includes only one magnet and the other is a magnetic material. Note that a magnetic material is a material or composition that produces a magnetic field in response to an applied magnetic field. The magnetic material may be a ferromagnetic material. Also note that this specification refers to first and second magnetic closures 66, 68 even though one of the first and second magnetic closures 66, 68 may be a magnetic material. Furthermore, any combination of magnets and magnetic material that allows for the magnetic closure and opening described herein to function may be used.

The first and second magnetic closures 66, 68 may be any suitable shape such as a rectangular or circular. Suitable numbers and combinations of the at least one first and second magnetic closures 66, 68 may also be used. In certain embodiments, the at least one first magnetic closure element 66 on each of the lower peripheral lip portion 60 comprises two spaced first magnetic closure elements 66, and wherein the at least one first magnetic closure element 66 on the first and second peripheral lip portions 62, 64 comprises two or three spaced first magnetic closure elements 66 on each of the first and second peripheral lip portions. In certain embodiments, the two first magnetic closure element 66 on the lower peripheral lip portion 60 are spaced apart to allow grasping the front panel 30 by a user's hand.

In certain embodiments the at least one second magnetic closure element 68 on the lower edge 20 of the body portion 16 comprises two spaced second magnetic closure elements 68, and wherein the at least one second magnetic closure element 68 on the first and second side edges 26, 28 of the body panel 16 comprises two or three spaced second magnetic closure elements 68. The first and second magnetic closures 66, 68 may be sewn into or embed/sandwiched in the material of the body panel 16 and the front panel 30.

Certain handgun holsters include a pocket to secure the handgun, and include a belt clip secured to the outside of the pocket. The belt clip is attached to the pocket such that when the holster is mounted to a user's belt, either outside-the-waistband (OWB) or inside-the-waistband (IWB), that the pistol is oriented in a generally vertical orientation with respect to the axis of the handgun barrel. As used herein, this will be referred to as a belt clip having a vertical position. Some handgun holsters have adjustable belt clips that allow a user to adjust the cant, or angle, of the holster when mounted to a user's belt via the belt clip in either IWB or OWB configuration. Typically, the cant is adjustable from 0 degrees (vertical) to +/−45 degrees. In other embodiments, the cant is adjustable to +/−30 degrees.

In certain embodiments, the pouch includes a holster engagement strip that is configured such that when either a right-handed holster or a left-handed holster is mounted on the holster engagement strip via the belt clip, the holster maintains a cant of up to 30 degrees above horizontal. In other embodiments, the holster engagement strip that is configured such that when either a right-handed holster or a left-handed holster is mounted on the holster engagement strip via the belt clip, the holster maintains a cant at least 20 degrees above horizontal for a holster having a belt clip that is oriented in the vertical position. In other embodiments, the holster engagement strip that is configured such that when either a right-handed holster or a left-handed holster is mounted on the holster engagement strip via the belt clip, the holster maintains a cant of between 20 degrees and 30 degrees above horizontal for a holster having a belt clip that is oriented in the vertical position.

In certain embodiments, a holster engagement strip 70 defines a first end 72, a second end 74, a central portion 76, an inner face 78 and an outer face 80.

Figure 10:
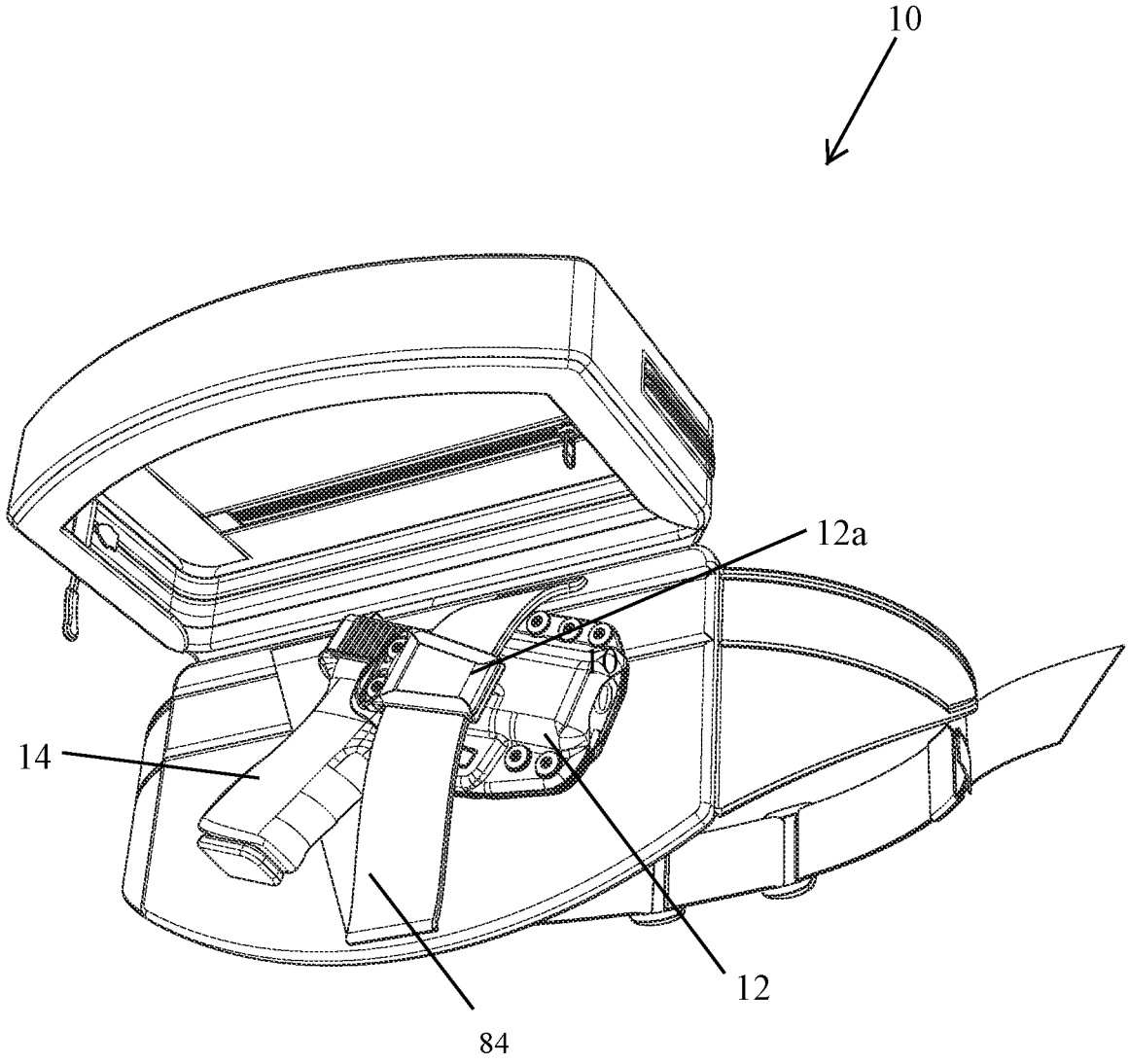
FIG. 10 is a bottom, front perspective view of the belt pouch of FIG. 1 in an open position supporting a right-handed holster.
Figure 11:
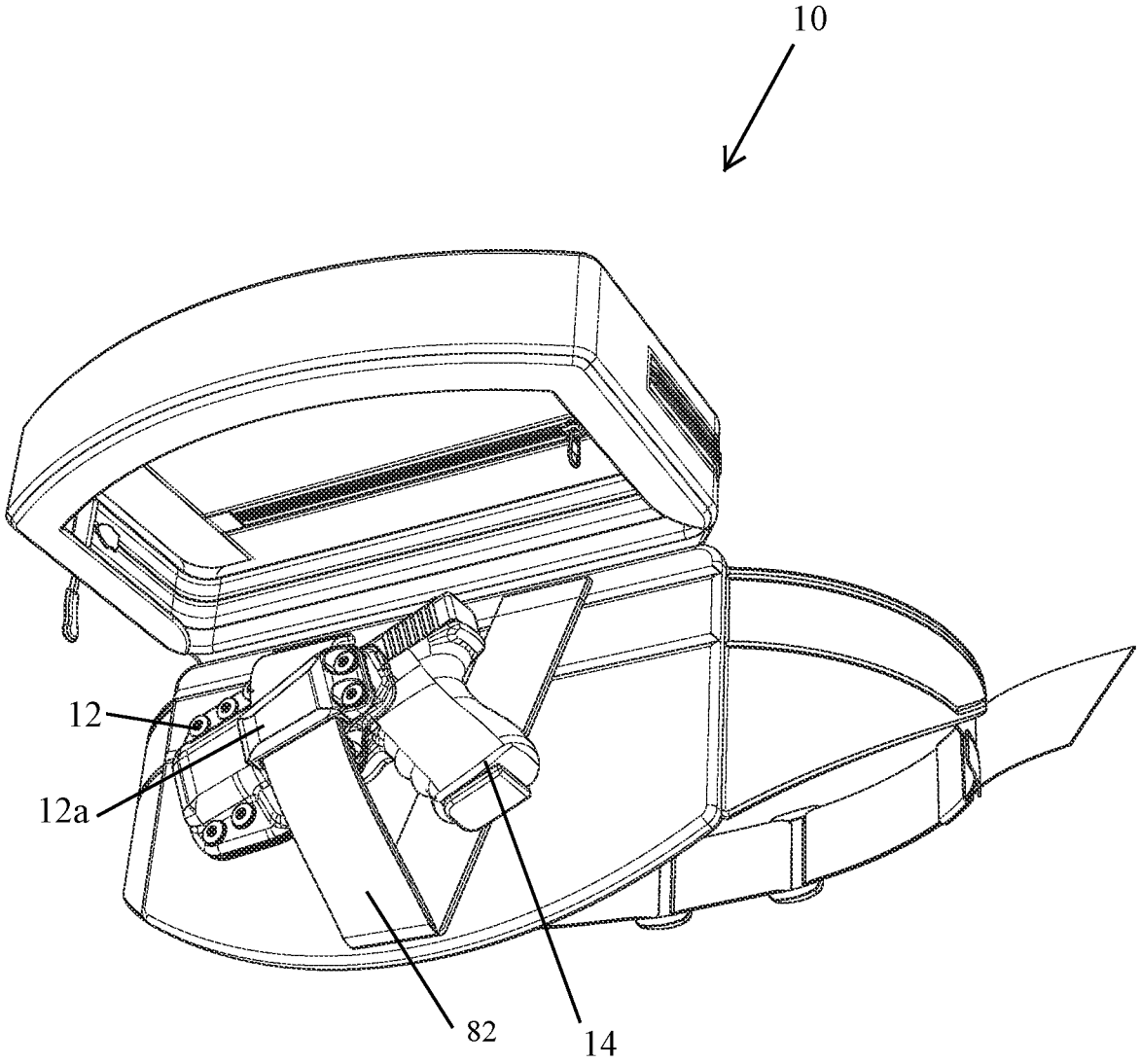
FIG. 11 is a bottom, front perspective view of the belt pouch of FIG. 1 in an open position supporting a left-handed holster.
Figure 12:
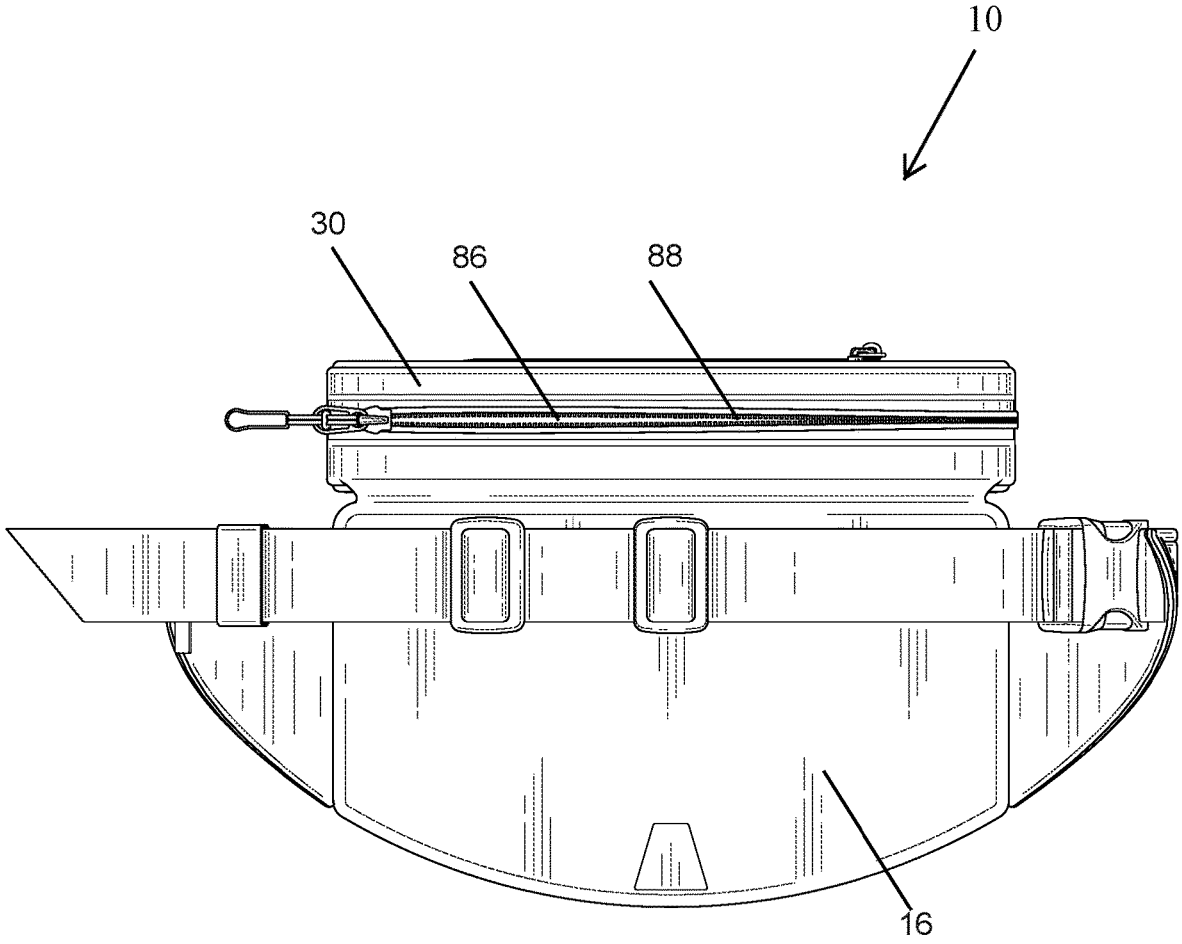
FIG. 12 is a top view of the belt pouch of FIG. 1 in a closed position showing access through a second access opening.

In certain embodiments, a holster engagement strip 70 may be secured to the outer face 24 of the body panel 16, wherein the first end 72 and the second end 74 are secured to the upper edge 18 of the body panel 16, and the central portion 76 is secured to the lower edge 20 of the body panel 16. A first holster mounting portion 82 is defined between the first end 72 of the holster engagement strip 70 and the central portion 76, and a second holster mounting portion 84 is defined from between the second end 74 of the holster engagement strip 70 and the central portion 76. In some embodiments, the first and second holster mounting portions 82, 84 are free from securement to the body panel 16 between the central portion 76 and first and second ends 72, 74 of the holster engagement strip 70. The first and second holster mounting portions 82, 84 are configured to mount a holster 12 between the body panel 16 and the first and second holster mounting portions 82, 84 with the holster clip 12*a* clipped on the outer face 80 of the holster engagement strip 70. In one embodiment, the first and second holster mounting portions 82, 84 are oppositely angled in a V-shape so as to be configured for accommodating left and right handed holsters 12 (see FIGS. 10, 11). In particular, the V-shape mounting portions 82, 84 allow a left-handed or right-handed IWB holster to be mounted in between the respective portion of the V-shape 82, 84 and the body panel 16. In FIG. 10, a right-handed IWB holster is mounted to V-shape mounting portion 84, and in FIG. 11, a left-handed IWB holster is mounted to V-shape mounting portion 82. V-shape mounting portion 84 can also accommodate a left-handed OWB holster in the same manner, and V-shape mounting portion 82 can also accommodate a right-handed OWB holster in the same manner.

In certain embodiments, holster engagement strip 70 is a single strip of material which is folded at the central portion 76 to form the V-shape, wherein each leg of the V-shape is formed by the first and second holster mounting portions 82, 84C. In certain embodiments, the angle between the first and second holster mounting portions 82, 84 is about 30° such that each of the first and second holster mounting portions 82, 84 is angled about 15° from vertical (as shown by angle $\alpha$ in FIG. 4) and about 75° from horizontal (as shown by angle $\beta$ in FIG. 4), wherein a holster 12 mounted on one of the first and second holster mounting portions 82, 84 is canted at about 30°. In certain embodiments, the holster engagement strip 70 is two separate strips formed in a V-shape, one or two vertical strips, or one or more strips formed in a W-shape for additional holster or magazine mounting locations. In certain embodiments, body panel 16 may have a hook and loop component for further securing a holster 12 having a corresponding hook and loop component in addition to belt clip 12*a*.

In certain embodiments, the first and second holster mounting portions 82, 84 angled in a V-shape are configured to make the holster pouch 10 wider but not as tall than if configured as a horizontal holster engagement strip. In certain embodiments, a holster 12 mounted on the first and second holster mounting portions 82, 84 angled in a V-shape wastes less space in the holster pouch 10 than if mounted on a horizontal or vertical engagement strip. In certain embodiments, the first and second holster mounting portions 82, 84 angled in a V-shape are configured to allow unholstering the handgun against tension provided by the holster engagement strip 70 on one end and the first belt portion 94 and second belt portion 96 attached to the user's body. The tension provided by a first belt portion 94 and second belt portion 96 make up for the lack of vertical constrainment typically provided by a user's belt constrained by belt loops on user's pants. In the case of a user wearing pants and a belt, the belt provides resistance to drawing a pistol vertically, allowing the holster to be retained during the draw stroke. In holster pouch 10, the resistance to vertical movement is not as strong as a belt and pants, so angling the draw stroke in a more horizontal direction allows more tension in addition to providing a more compact and ergonomic profile. In certain embodiments, the holster pouch 10 is configured to hold a holster 12 such as a passive retention holster.

In some embodiments, holster engagement strip 70 may comprise a rigid nylon webbing material such as scuba webbing material. In other embodiments, the holster engagement strip 70 is sufficiently rigid such that it is capable of securely supporting a holster 12 and handgun 14 combination without sagging or buckling. In other embodiments, the holster engagement strap 70 is sufficiently rigid such that it the holster engagement strip 70 is difficult to compress or buckle under pressure of the user's hand squeezing the holster engagement strip from the top and bottom edges of the holster engagement strip 70. Holster engagement strip 70 has a width sufficient to engage with a holster clip 12*a* of a holster. In certain embodiments, the holster engagement strip 70 is about 1.5 inches to 1.75 inches. In certain embodiments, holster engagement strip 70 is about 1.5 inches. In certain embodiments, holster engagement strip 70 is configured as a double layer of rigid nylon webbing material. In certain embodiments, holster engagement strip 70 has a thickness of 0.2 inches to 0.25 inches. In certain embodiments, holster engagement strip 70 may be constructed from fabric, extruded plastic, metal, etc.

Some embodiments include a second access opening configured to provide access to the pouch interior without swinging the front panel to the open position. In further embodiments, the second access opening is included in one of the front panel and peripheral sidewall. In certain embodiments, the second access opening is configured to all the user to insert a hand into the pouch interior to grasp the handgun, and withdraw the handgun from the holster and out of the second access opening. In certain embodiments, referring to FIGS. 3 and 12, a second access opening 86 extends along at least the upper side wall portion 46 of the peripheral sidewall 44 and may also extend along the first and second side wall portions 50, 52 of the peripheral sidewall 44. The second access opening 86 is configured to be opened and closed by a first zipper 88 comprising mating rows of interlockable zipper teeth 90, and at least one zipper slider element 92 movable along the mating zipper teeth 80, wherein the zipper slider element 92 is configured to be moved between an open and closed position. The open position of the zipper slider element 92 is configured to provide access through the second access opening 86 to the pouch interior 56 and a handgun 14 supported within the pouch interior 56 by a holster 12 attached to the holster engagement strip 70. In certain embodiments, instead of a zipper, second access opening 86 may utilize closure alternatives such as hook and loop closures, magnets, adhesive, embedded leaf springs, etc.

Figure 3:
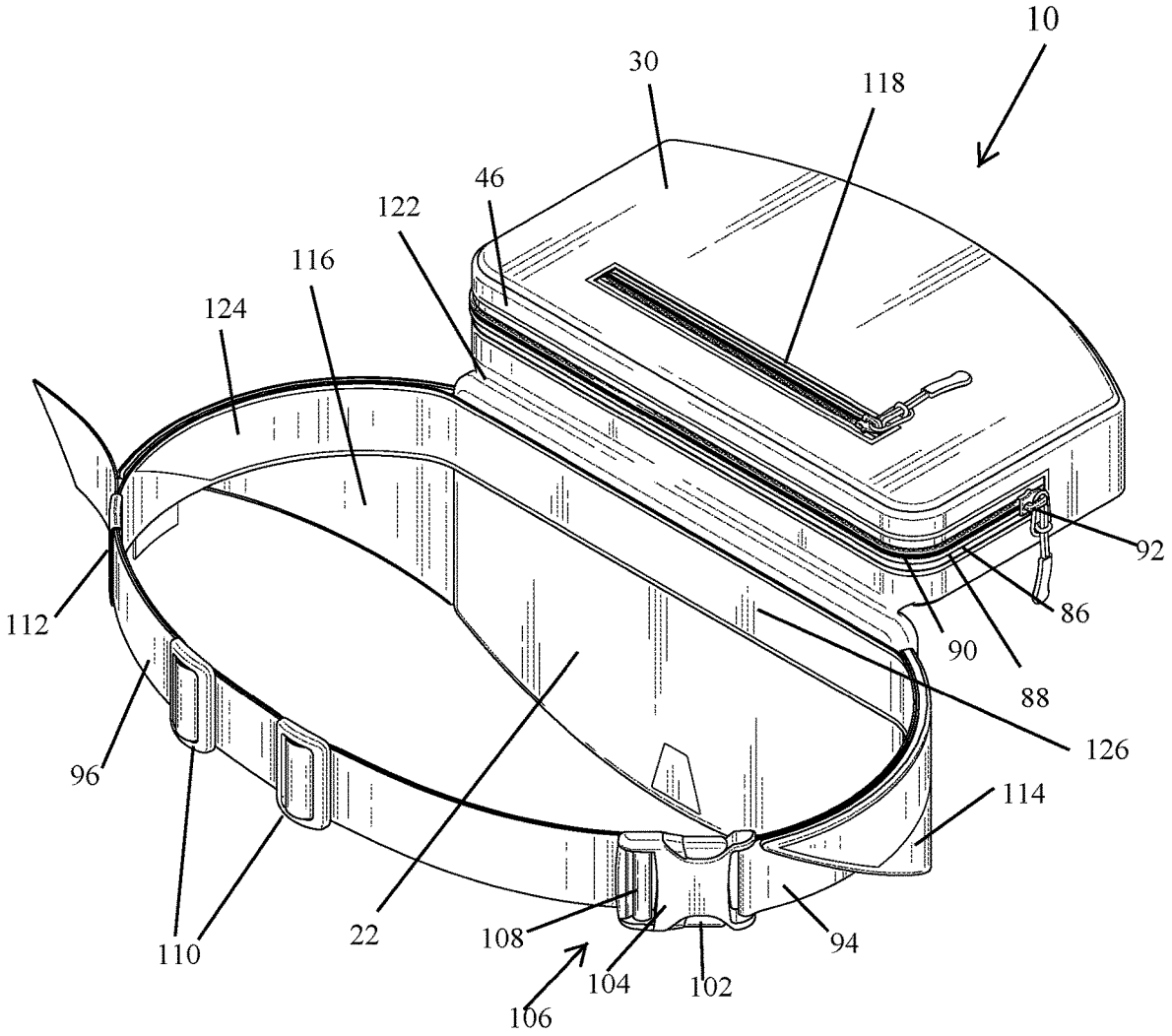
FIG. 3 is a top, rear perspective view of the belt pouch of FIG. 1 in an open position.
Figure 4:
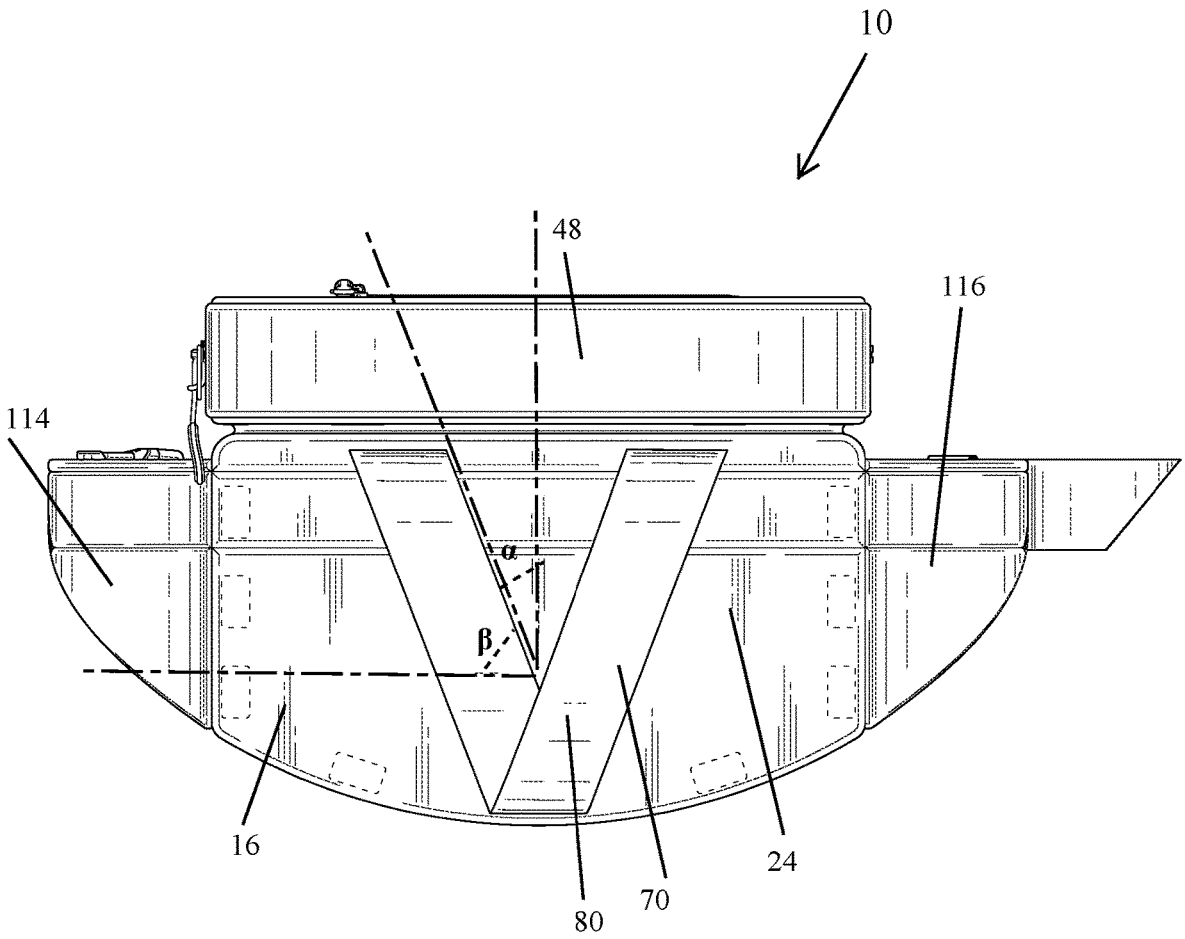
FIG. 4 is a front view of the belt pouch of FIG. 1 in an open position.
Figure 5:
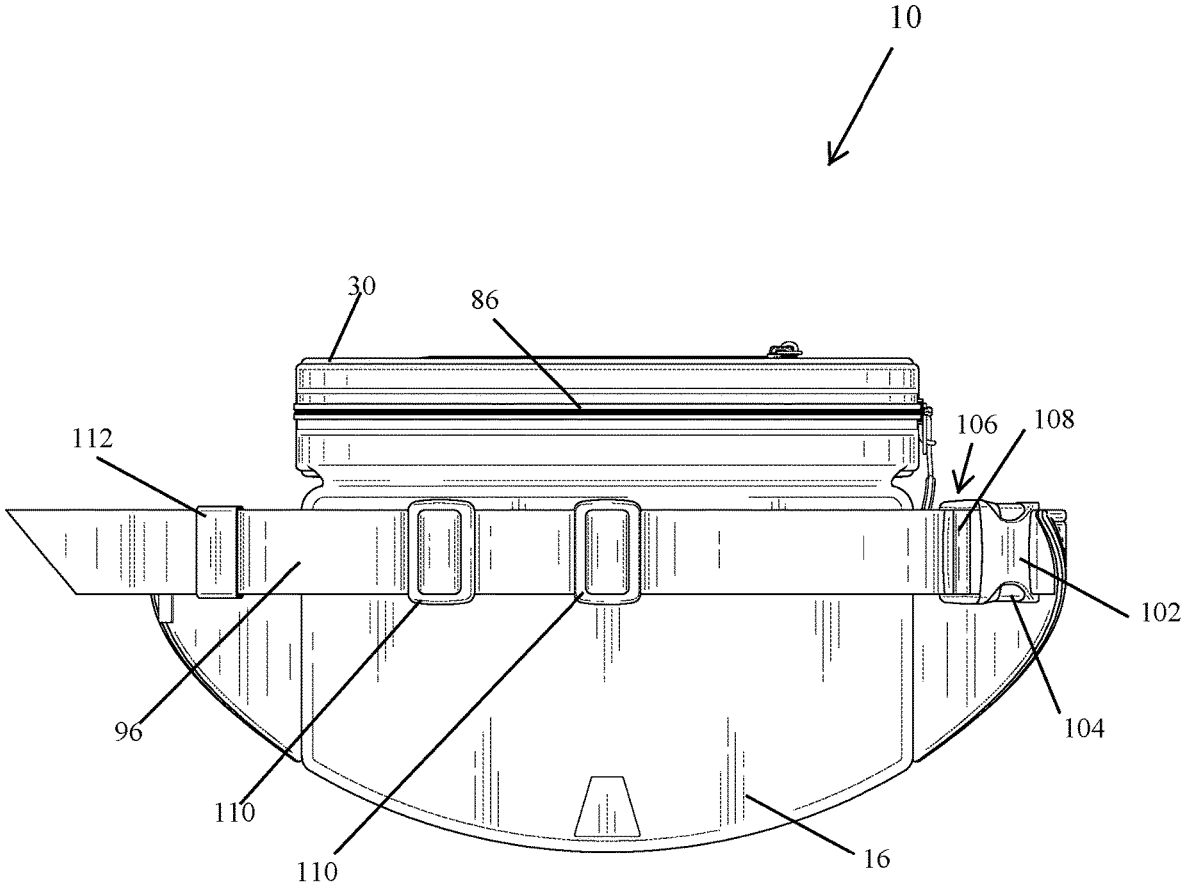
FIG. 5 is a rear view of the belt pouch of FIG. 1 in an open position.
Figure 6:
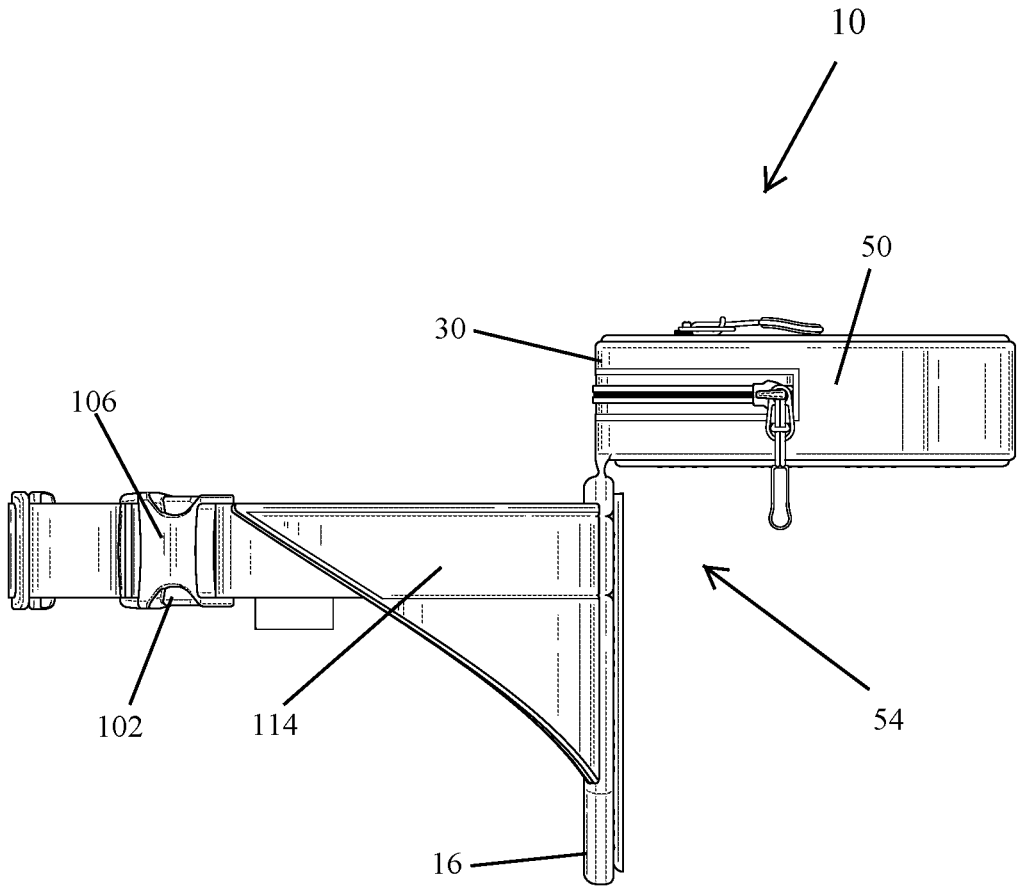
FIG. 6 is a right side view of the belt pouch of FIG. 1 in an open position.
Figure 7:
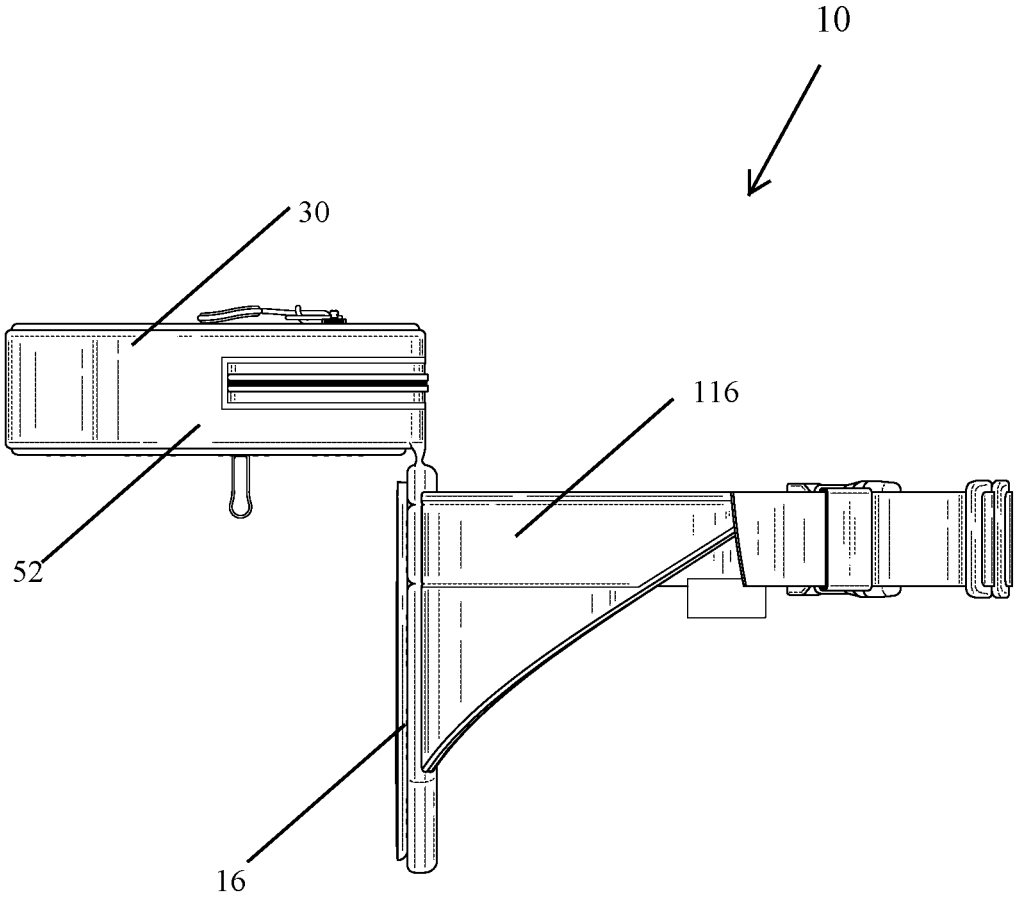
FIG. 7 is a left side view of the belt pouch of FIG. 1 in an open position.
Figure 8:
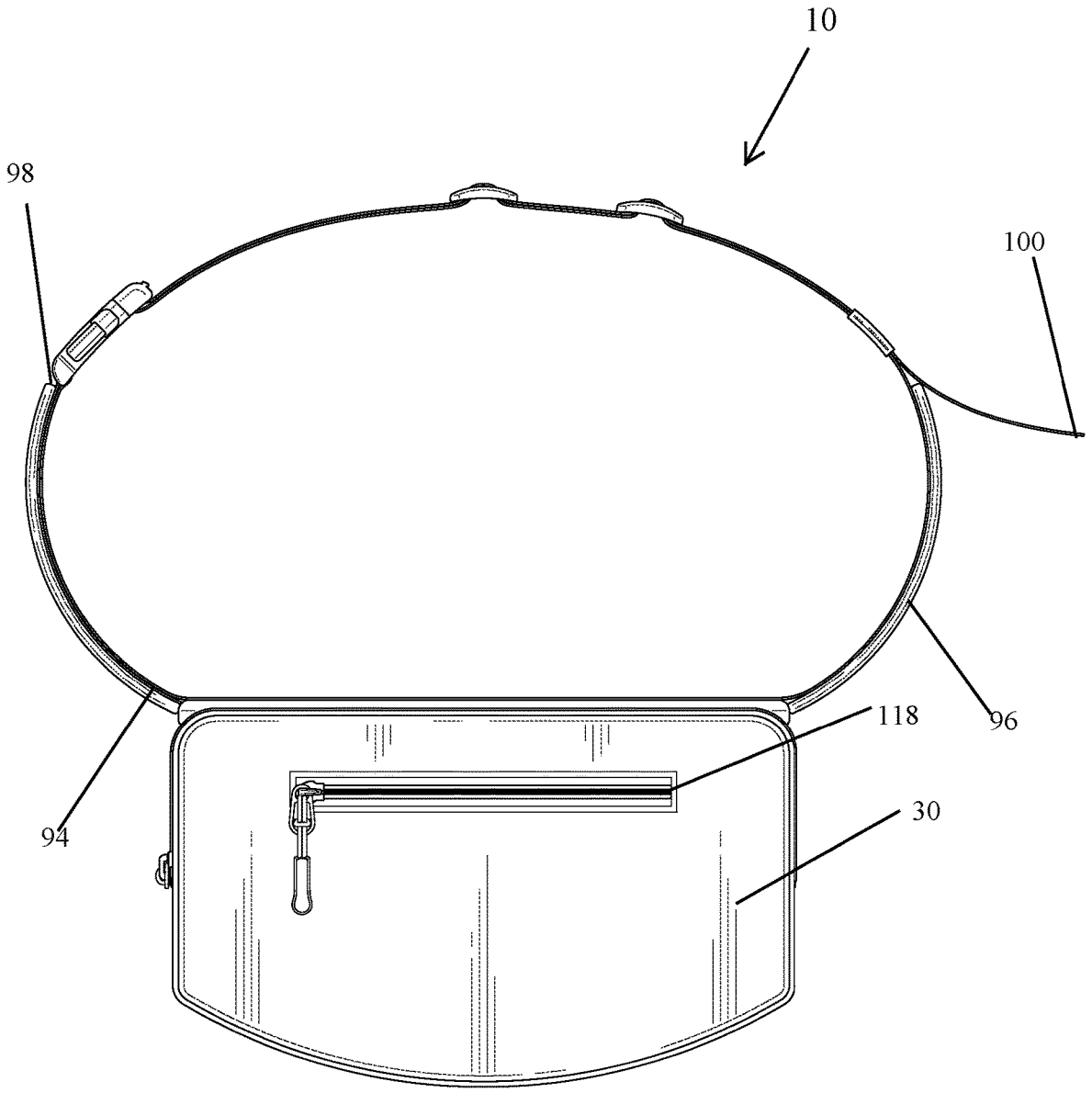
FIG. 8 is a top view of the belt pouch of FIG. 1 in an open position.
Figure 9:
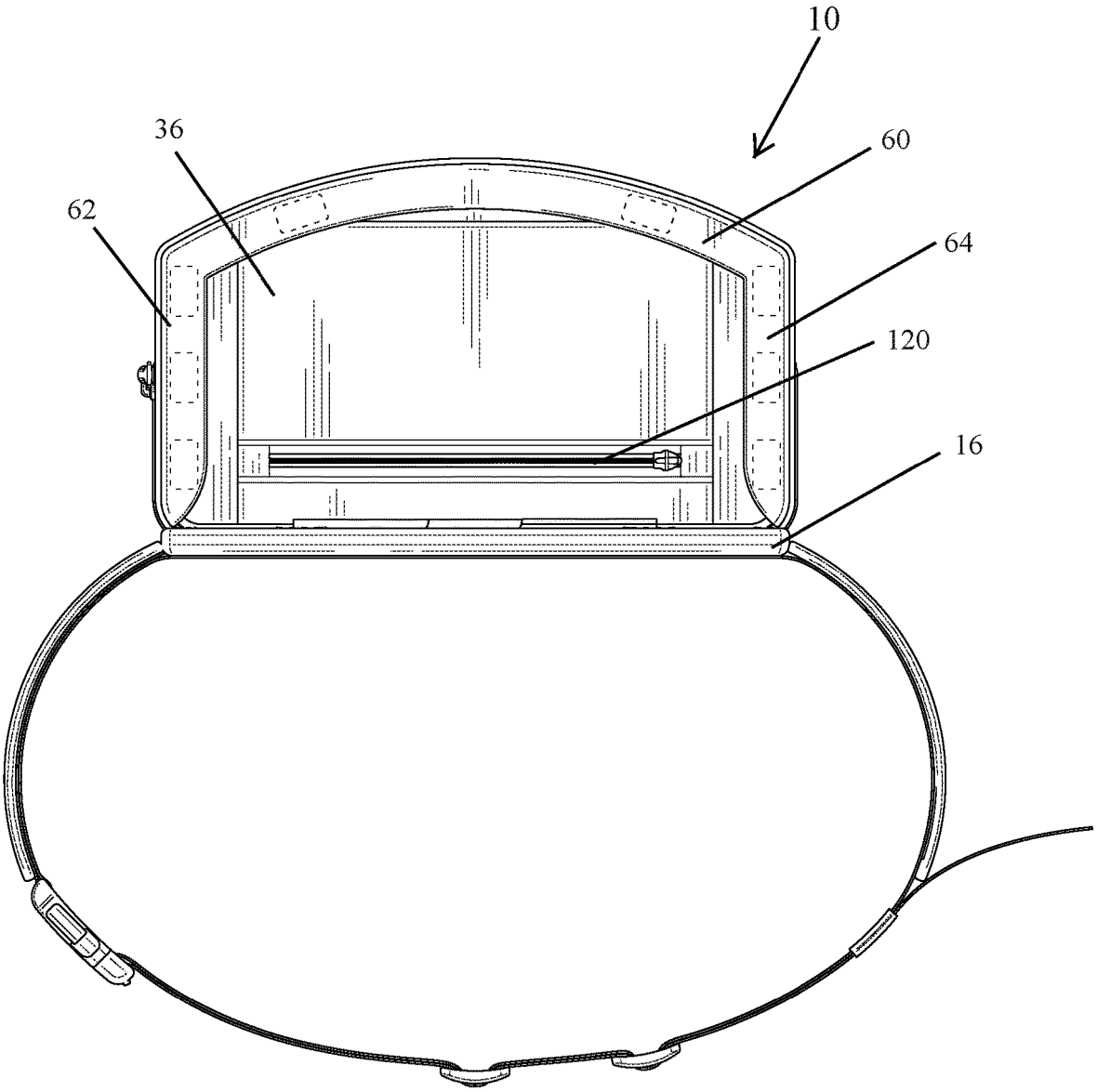
FIG. 9 is a bottom view of the belt pouch of FIG. 1 in an open position.

In embodiments, referring to FIG. 3, the belt pouch 10 further has belt 124 having a first belt portion 94 having a first end 98, a second belt portion 96 having a second end 100 and a central portion 126 disposed between the first belt portion 94 and the second belt portion 96. In embodiments, central portion 126 extends across and is joined or secured to body panel 16. In certain embodiments a first coupler 102 is disposed on first end 98 and a second coupler 104 is disposed on the second end 100, wherein the first coupler 102 is arranged to releasably couple together with the second coupler 104 on the second belt portion 96 to secure the belt pouch 10 around the waist of a user. In certain embodiments, the first belt portion 94 further comprises a first side wing portion 114 and the second belt portion 96 further comprises a second side wing portion 116, each disposed adjacent the body panel 16. In certain embodiments, each side wing portion 114, 116 has a triangular shape is configured to provide structural stability and add comfort.

In embodiments, belt 124 is a one-piece, continuous member extending from the first end 98 and first coupler 102, through first side wing portion 114, body panel 16, second side wing portion 116 to the second end 100 and second coupler 104. In embodiments, belt 124 is a 1.5 inch soft waist strap made of a non-stretchable, flexible material, such a lightweight nylon webbing. In embodiments, the belt 124 is attached near the upper edge 18 of the inner face 22 of the body panel 16 and is configured to add structural integrity to the body panel 16.

In embodiments, the body panel 16, the front panel 30, first and second side wing portions 114, 116 have padding such as a synthetic closed-cell foam 128 insert configured to increase structural form and add comfort. In certain embodiments, the body panel 16 including the layer of padding of the body panel 16 is configured as a leaf spring to providing a lateral force against a holster 12 supported by the holster engagement strip 70. In other embodiments, the body panel 16 including the layer of padding of the body panel 16 is more compliant than the holster engagement strip 70, such that the body panel 16 deflects more than the holster engagements strip 70 when a holster 12 is inserted between body panel 70 and holster engagements strip 70 and secured by a belt clip 12*a*. The inner face 22 of the body panel 16 has three-dimensional (3D) mesh fabric, for example, for breathability and comfort. An outer shell 130 of the body panel 16, the front panel 30, first and second side wing portions 114, 116 are constructed of a lightweight, water-resistant polyester fabric such as 200D Polyester, for example.

In embodiments, the first and second couplers 102 and 104 are, for example, male and female elements of a side release buckle. In alternative embodiments, the first and second couplers 102 and 104 may comprise other buckle types, hooks, snaps, clasps, double D rings, hook and loop material, or any other suitable couplers sufficient to accomplish the task of connecting belt pouch 10 around the waist of a user.

In embodiments, belt pouch 10 includes an adjustment mechanism 106 comprising a cinch adjuster 108, and one or more tensioner slides 110 and/or a belt loop 112 which are configured to adjust the length of one of the first and second belt portions 94, 96. In the illustrated embodiment, the length of second belt portion 96 is adjustable and is configured to thread through the cinch adjuster 108 disposed on one of the first and second couplers 102 and 104, and then folded back and adjustably secured by the one or more tensioner slides 110 and/or a belt loop 112. In certain embodiments, portions of one or both of the first and second belt portions 94, 96 are formed from nylon belt material.

In certain embodiments, the front panel 30 further comprises at least one exterior zippered pocket 118 opening on the outer face 38 of the front panel 30, at least one interior zippered pocket 120 opening on the inner face 36 of the front panel 30 wherein the at least one exterior and interior pockets 118, 120 are configured to hold other items such as accessories or a wallet.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be omitted or replaced by alternative features serving the same, equivalent or similar purpose, unless expressly stated otherwise. Certain features may sometimes be used to advantage without a corresponding use of other features. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This disclosure is intended to cover adaptations or variations of the present subject matter. Applicants intend to embrace all such alternatives, modifications, equivalents, and variations that are within the spirit and scope of the exemplary embodiments. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A belt pouch comprising:

a body panel defining an upper edge, a lower edge, an inner face, an outer face and first and second side edges;

a front panel defining an upper edge, a lower edge, an inner face, an outer face and first and second side edges;

a peripheral side wall extending rearwardly from the upper edge, the lower edge and the first and second side edges of the front panel toward corresponding edges of the body panel, the peripheral side wall defining an upper side wall portion extending from the upper edge of the front panel, a lower side wall portion extending from the lower edge of the front panel, a first side wall portion and a second side wall portion extending from the first and second side edges of the front panel, wherein the upper side wall portion is hingedly joined to the upper edge of the body panel and configured to be swung upwardly from a closed position of the front panel to an open position of the front panel to expose the body panel and form a first access opening, wherein a pouch interior is formed between the front panel, the body panel and the peripheral side wall when the front panel is in the closed position, wherein the pouch interior is sized to completely enclose a handgun and a holster combination, wherein the holster comprises a holster body configured for receiving the handgun and a belt clip;

a peripheral lip extending transversely from the lower side wall portion and the first and second side wall portions, the peripheral lip defining a lower peripheral lip portion extending from the lower side wall portion, and first and second peripheral lip portions extending from the first and second side wall portions;

at least one first magnetic closure element on each of the lower peripheral lip portion, and the first and second peripheral lip portions;

at least one second magnetic closure element corresponding to the at least one first magnetic closure element and disposed at the lower edge portion, and the first and second side edges of the body panel, wherein the at least one first and second magnetic closures are configured to releasably secure the front panel to the body panel when the front panel is in the closed position;

a holster engagement strip defining a first end, a second end, a central portion, an inner face and an outer face, wherein the holster engagement strip has a width sized for engagement with the belt clip of the holster;

wherein the holster engagement strip is secured to the outer face of the body panel, wherein the first end and the second end of the holster engagement strip are secured to the upper edge of the body panel, and the central portion is secured to the lower edge of the body panel, wherein a first holster mounting portion is defined between the first end of the holster engagement strip and the central portion, and a second holster mounting portion is defined from between the second end of the holster engagement strip and the central portion, wherein the first and second holster mounting portions are free from securement to the body panel between the central portion and first and second ends of the holster engagement strip, wherein the first and second holster mounting portions are configured to mount the holster between the body panel and the respective holster mounting portion, wherein the first and second holster mounting portions are oppositely angled forming a V-shape and to be configured for accommodating left and right handed holsters;

a second access opening extending along the upper side wall portion, the second access opening comprising a first zipper comprising mating rows of interlockable zipper teeth, and at least one zipper slider element movable along the mating zipper teeth, wherein the zipper slider element is configured to be move between an open and closed position, wherein the open position of the zipper element is configured to provide access to the pouch interior;

a unitary belt defining a first belt portion comprising a first end of the belt, a second belt portion comprising a second end of the belt and a central portion disposed between the first belt portion and the second belt portion, wherein the central portion is joined to the body panel; and at least one coupler disposed on at least one of the first end of the belt and the second end of the belt, wherein the at least one coupler is configured to couple together the first end and the second end.

2. The belt pouch of claim 1, wherein the first and second holster mounting portions are each angled about 15° with respect to vertical.

3. The belt pouch of claim 1, wherein the holster engagement strip comprises a nylon webbing material having a rigidity sufficient to support the holster and handgun combination.

4. The belt pouch of claim 1, wherein the holster engagement strip comprises a scuba webbing material having a width of about 1.5 inches.

5. The belt pouch of claim 1, wherein the second access opening further extends along the first side wall portion and the second side wall portion.

6. The belt pouch of claim 1, wherein each of the body panel and the front panel further comprises a padding material.

7. The belt pouch of claim 6, wherein the padding material comprises a synthetic closed cell foam.

8. The belt pouch of claim 7, wherein the padding material of the body panel is configured to provide a lateral force against the holster and handgun combination between the body panel and the holster engagement strip.

9. The belt pouch of claim 1, wherein the at least one second magnetic closure element are embedded in the body panel.

10. The belt pouch of claim 1, wherein the at least one first magnetic closure element on each of the lower peripheral lip portion comprises two spaced first magnetic closure elements, and wherein the at least one first magnetic closure element on the first and second peripheral lip portions comprises two spaced first magnetic closure elements on each of the first and second peripheral lip portions;

wherein the at least one second magnetic closure element on the lower edge portion of the body portion comprises two spaced second magnetic closure elements, and wherein the at least one second magnetic closure element on the first and second side edges of the body panel comprises two spaced second magnetic closure elements.

11. The belt pouch of claim 1, wherein the at least one first magnetic closure and the at least one second magnetic closure comprise rare-earth magnets.

12. The belt pouch of claim 1, wherein the front panel further comprises at least one exterior pocket opening on the outer face of the front panel.

13. The belt pouch of claim 1, wherein the front panel further comprises at least one interior pocket opening on the inner face of the front panel.

14. The belt pouch of claim 1, wherein the first belt portion and the second belt portion each further comprises a respective first and second side wing portion disposed adjacent the body.

15. The belt pouch of claim 14, wherein each side wing portion has a triangular shape, wherein each side wing portion comprises padding material.

16. The belt pouch of claim 14, wherein the belt is a one-piece, continuous member extending from the first end of the belt, through the first side wing portion, the body panel, the second side wing portion to the second end of the belt.

17. The belt pouch of claim 1, wherein the at least one coupler comprises a first coupler disposed on the first end of the first belt portion and a second coupler disposed on the second end of the second belt portion, wherein the first coupler and second coupler are configured to couple together the first end of the first belt portion and the second end of the second belt portion.

18. The belt pouch of claim 17, further comprising an adjustment mechanism configured to adjust a length of one of the first and second belt portions.

19. The belt pouch of claim 18, wherein the adjustment mechanism comprises a cinch adjuster to secure one of the first and second belt portions.

20. A belt pouch comprising:

a body panel;

a front panel;

wherein the front panel is hingedly joined to the body panel at an upper edge of the body panel and configured to be swung upwardly, when secured around a user's waist, from a closed position of the front panel to an open position of the front panel to expose the body panel and form a first access opening, wherein a pouch interior is formed between the front panel and the body panel, wherein the pouch interior is sized to completely enclose a handgun and a holster combination inside the pouch interior when the front panel is in a closed position;

at least one first closure element on at least one of the front panel, the body panel, and combinations thereof, the closure element configured to releasably secure the front panel to the body panel when the front panel is in the closed position;

a holster engagement strip comprising a width sized for engagement with a belt clip of the holster;

wherein the holster engagement strip is secured to an outer face of the body panel and configured to mount the holster between the body panel and the holster engagement strip;

wherein the holster engagement strip is configured such that when either right-handed holster or a left-handed holster is mounted on the holster engagement strip, the holster maintains a cant at least twenty degrees above horizontal;

the front panel comprising a second access opening wherein the second access opening is configured to provide access to the pouch interior without swinging the front panel to the open position;

a belt portion configured to secure the belt pouch around a user's waist.

21. The belt pouch of claim 20, wherein the holster engagement strip comprises oppositely angled portions forming a V-shape.

22. The belt pouch of claim 20, wherein the holster engagement strip and the outer face of the body panel do not comprise hook and loop fasteners.

23. The belt pouch of claim 20, wherein the second access opening is disposed within an upper sidewall of the belt pouch.

* * * * *